United States Patent [19]

Jackson

[11] Patent Number: 4,921,533

[45] Date of Patent: May 1, 1990

[54] FERRO-ALUMINUM COMPOSITE PIG

[75] Inventor: Edward S. Jackson, North Canton, Ohio

[73] Assignee: Galt Industries, Inc., Canton, Ohio

[21] Appl. No.: 361,232

[22] Filed: Jun. 5, 1989

[51] Int. Cl.[5] ..... C21C 7/02

[52] U.S. Cl. ..... 75/315; 75/568; 164/80

[58] Field of Search ..... 75/53, 58, 44 S, 63, 75/65 R, 67 R, 57

[56] References Cited

U.S. PATENT DOCUMENTS 3,396,777 8/1968 Reding ..... 75/67 R 3,634,066 1/1972 Matthews ..... 75/65 R 3,948,612 4/1976 Schulten-Bauman ..... 75/44 S

*Primary Examiner*—Peter D. Rosenberg

*Attorney, Agent, or Firm*—Hopgood, Calimafde, Kalil, Blaustein & Judlowe

[57] ABSTRACT

An article of manufacture is provided in the form of a composite pig comprising a matrix of a ferro-aluminum alloy containing over about 55% and ranging up to about 75% aluminum and the balance essentially iron, the matrix alloy having distributed therethrough pieces of iron or steel in an amount sufficient to provide an overall pig composition of about 25% to 55% aluminum and the balance iron, including a densith of at least about 5 gr/cm$^3$. The composite pig has particular use as a deoxidation agent for steel.

9 Claims, 1 Drawing Sheet

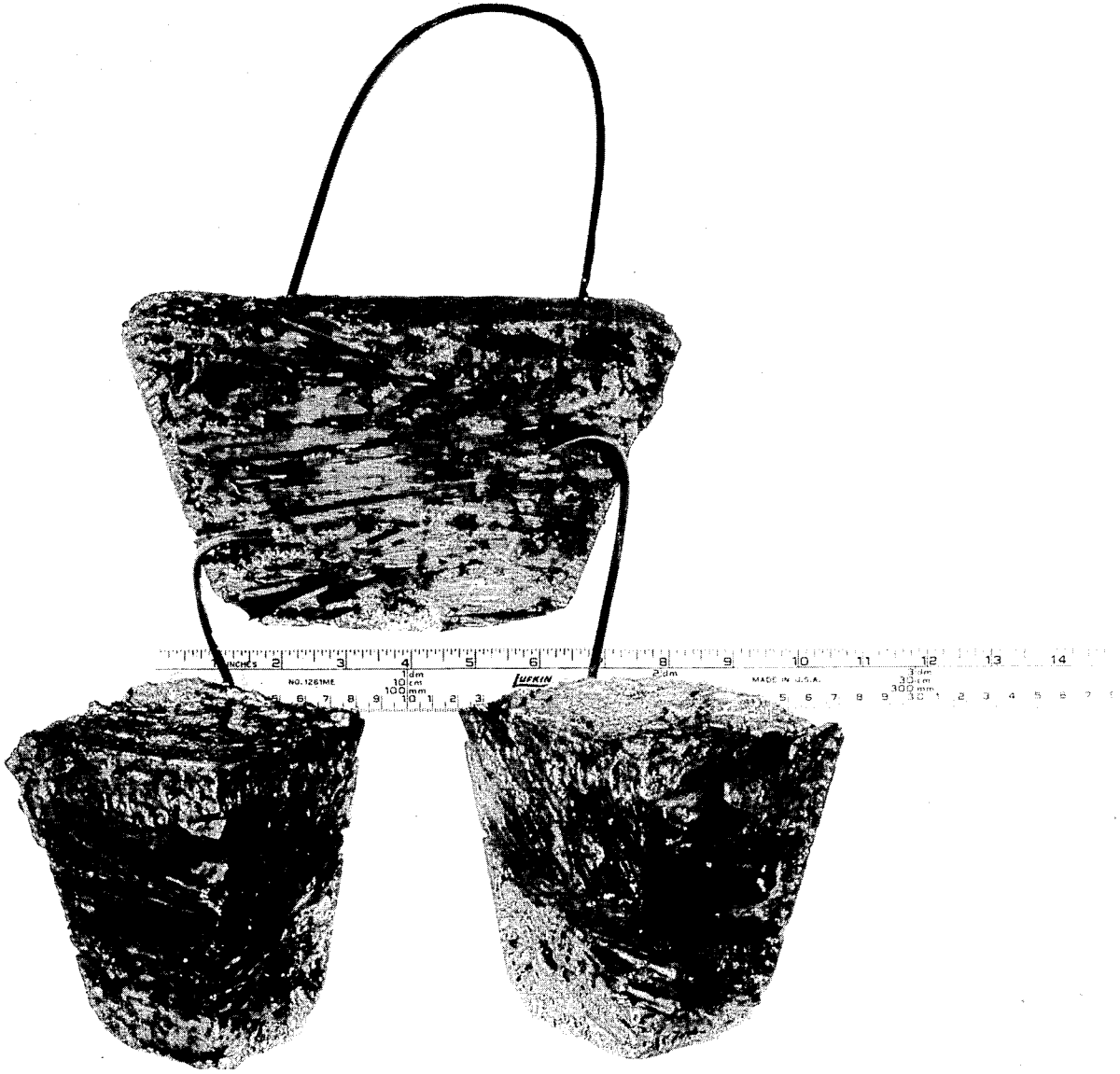

FERRO-ALUMINUM COMPOSITE PIG

FIELD OF THE INVENTION

This invention relates to a ferro-aluminum composite pig adapted for use as an addition agent for molten ferrous metals, e.g., steel, and in particular, to a deoxidizing agent for molten steel.

BACKGROUND OF THE INVENTION

It is known to use aluminum both as a deoxidizing agent and as an alloy additive to steel. Aluminum is a very reactive metal with oxygen-containing atmospheres at elevated temperatures in that it reacts uncontrollably and exothermically with oxygen. The free energy of reaction is very high. Thus, the reaction is difficult to control once it starts, although it is this property which is used to deoxidize iron or steel when controlled properly. The terms "iron" or "steel" used herein are used interchangeably. Whenever one term is used, it includes the other.

As a deoxidizing agent, aluminum per se is very inefficient as much of it is lost during submersion into the steel bath. Because of its low density, it remains near the surface of the bath and tends to react with the furnace atmosphere which contains some oxygen and also with the slag. The reaction is limited to a small area unless some stirring means is employed. However, even this has its limitations.

Thus, it has been the practice to add aluminum as a ferro-aluminum alloy. The alloy having a higher density than aluminum per se penetrates the steel bath more easily when emersed and does not react as rapidly and thereby provides better control of deoxidation or alloying, if alloying is the objective.

Generally speaking, the composition of commercially available ferro-aluminum alloy is nominally 35 to 40% aluminum and 65% to 60% iron or steel. However, this alloy has poor storage stability in that it tends to decrepitate, crumble and fall apart. While such pieces can be and have been used to deoxidize steel, they are difficult to handle and to provide efficient submersion into the steel bath. In addition, the pieces or chunks tend to break down further due to thermal shock when added to the steel bath which has an adverse affect on the efficiency of deoxidation.

To avoid the foregoing, the ferro-aluminum alloys employed contained low amounts of aluminum ranging from about 25% to 30% by weight, since these alloys maintain their structural integrity during storage.

Recently a patent has issued (U.S. Pat. No. 4,801,328) which attempts to overcome the foregoing problem by going back to the use of substantially pure aluminum, but using it in a different way. According to the patent, a deoxidizing agent is provided which utilizes a core of material which is chemically non-reactive with molten ferrous metal (e.g., a core of iron) and which has a density substantially greater than that for aluminum. Using the core as a substrate, it is completely covered by one or more discrete layers of metallic aluminum to provide an average composition ranging from 30% to 50% Al. Because of the use of metallic aluminum, the addition agent has good integrity and does not decrepitate or crumble.

The aluminum used is substantially pure. According to the patent, it is preferably maintained at a purity level of 95% or higher of aluminum. The patent reports improved deoxidation efficiency when the deoxidizing agent of the invention is used. However, from the data reported, the improvement isn't that much better than the use of conventional ferro-aluminum alloy alone.

A disadvantage of the patented invention is that metallic aluminum used has a very low melting point of about 659° C. compared to iron or steel which is about 1530° C. Because of this, the aluminum tends to melt substantially immediately and therefore tends to separate from the core which does not allow sufficient time to carry out the reaction without using excess deoxidizing agent.

Applicant has discovered a method of using ferro-aluminum alloy itself over the effective range of about 25% to 55% aluminum and the balance iron which will withstand storage and not decrepitate or crumble.

OBJECTS OF THE INVENTION

One object of the invention is to provide as an article of manufacture a composite pig comprising a matrix of a ferro-aluminum alloy having distributed therethrough pieces of iron or steel, said composite pig being capable of being stored without decrepitating or crumbling.

Another object is to provide a method for producing said composite pig.

A further object is to provide a method of treating or alloying steel using a composite pig comprising a ferro-aluminum composition.

These and other objects will more clearly appear from the following disclosure, the appending claims and the accompanying drawing.

IN THE DRAWING

The accompanying FIGURE is a reproduction of a photograph showing a composite pig in section comprising a matrix of a ferro-aluminum alloy containing at least about 55% aluminum characterized by structural integrity, said matrix having pieces of steel scrap distributed therethrough.

SUMMARY OF THE INVENTION

Stating it broadly, the invention is directed to an article of manufacture comprising a ferro-aluminum addition agent in the form of a composite pig. The composite pig comprises a matrix of a ferro-aluminum alloy containing by weight over 55% to 75% aluminum and balance essentially iron, the matrix having distributed therethrough pieces of undissolved iron or steel, such as scrap, in an amount sufficient to provide an average overall composition of about 25% to 55% by weight of aluminum, and the balance essentially iron, the balance iron including both the iron in the ferro-aluminum and the pieces of iron distributed as undissolved iron in the matrix. The composite composition is such as to provide an apparent density of at least about 5 grs/cm$^3$. Thus, the invention provides a product having an enhanced density.

Aluminum has a density of about 2.7 grs/cm$^3$, while iron and low or medium carbon steel have a density of about 7.86 grs/cm$^3$. A preferred final composition of the composite pig is one containing about 40% aluminum and balance essentially iron. This alloy has a density of about 5.8 grs/cm$^3$. Normally, as stated hereinbefore, a ferro-aluminum alloy containing 40% aluminum has poor storage stability, that is, it decrepitates and crumbes with time. However, the composite pig of the invention having an average content of 40% aluminum does not. This is achieved by using a matrix alloy composition of over 55% to about 75% aluminum and balance essentially iron.

DETAILS OF THE INVENTION

In a preferred embodiment of the invention, the matrix ferro-aluminum alloy employed is one containing about 65% aluminum and the balance essentially iron.

The advantage of the composite pig over the deoxidizing alloy of U.S. Pat. No. 4,801,328 is that the matrix alloy employed in the invention has a substantially higher melting point that metallic or pure aluminum, is less reactive than aluminum, and retains its structural integrity for a longer period of time as it sinks into the molten steel bath and begins to dissolve therein and react with oxygen dissolved in the steel.

The unique aspect of this invention is that the 65% ferro-aluminum alloy has not been used commercially for the reason that the lower density thereof (less than 4 grs/cm$^3$) does not provide the increased depth of submersion in the steel bath. The density of the slag in a steel furnace may range from about 2.5 to 3.5 or 4. Thus, the density of the addition alloy must be in substantial excess of 4 to assure penetration into the molten metal bath. The invention enhances the density of the alloy by forming a composite pig thereof.

The benefit of using a ferro-aluminum alloy composition of low reactivity is to decrease the oxidation losses of aluminum near the surface and above the slag/metal interface. That portion of the density enhanced ferro-aluminum not dissolving in the bath provides available aluminum to the remaining undeoxidized steel as it is transferred to the ladle from the furnace. Therefore, the greater efficiency provided by this invention reduces the total amount of oxides in the steel bath resulting in a cleaner end product.

The invention has a further benefit of providing efficient deoxidation in a ladle. Since many of the benefits of the use of ferro-aluminum as a deoxidizer are also present in the composite material on the invention, it will not have the same chilling effect that a low aluminum ferro-aluminum additional alloy has, that is, a low aluminum alloy containing about 25% Al and the balance Fe. It will resist melting at the bottom of a preheated ladle prior to furnace tap, since the melting temperature (about 2200° F.) is approximately 100° F. above the pre-heat temperature of 2100° F. of the ladle.

In producing the article of manufacture provided by the invention, a mold in the shape of an inverted truncated pyramid may be employed. A twenty-five pound ingot or pig may be produced with an attaching handle of iron (note the drawing) to enable its use as a furnace addition.

In producing the composite pig of the invention, a series of truncated pyramid molds would be used. The molds are prepared each with a charge of scrap steel (low carbon, medium carbon steel, etc.) in the form of pieces such as strip or sheet clippings, bolts, etc., which are spatially distributed in the mold in preparation for pouring.

In a preferred embodiment, the matrix ferro-aluminum alloy is produced in a furnace using standard procedures to provide a composition containing 65% aluminum and the balance essentially iron. The furnace is filled with low copper aluminum scrap and low carbon steel scrap. Each of the molds are arranged with preweighed addition of scrap steel (e.g., low carbon steel) corresponding to the final composite composition to be produced. The 65% ferro-aluminum heat is poured into the molds to produce a composite pig which overall has a composition of about 40% aluminum and the balance essentially iron.

A typical 2000 lb. charge is calculated as follows:

$$X = \text{wt of 65\% Fe/Al alloy}$$

$$2000 - X = \text{wt of additional iron to be used}$$

$$0.65X = \text{wt of Al in alloy}$$

$$\frac{0.65X}{2000} = 0.4 \text{ (for 40\% Fe/Al alloy)}$$

$$X = \frac{800}{0.65} = 1230.77$$

$$\text{Amount of steel to be added} = 2000 - 1230.77 = 769.23$$

$$\text{Total Al} = 800 \text{ lbs.}$$

$$\text{\% Al in composite} = \frac{800}{2000} \times 100 = 40\% \text{ by wt Al}$$

The ferro-aluminum alloy when melted and poured into the molds containing the scrap is very fluid, and flows into and fills the interstices between the spatially arranged pieces of scrap. Thus, while the matrix alloy is actually a 65% aluminum alloy, it has the properties of a 40% alloy in terms of density.

The invention can thus provide an alloy as a composite pig ranging in overall aluminum composition ranging from about 25% to 55% and provide apparent densities substantially exceeding that of metallic aluminum (about 2.7) ranging from approximately 5 to as high as 6.2 or 6.3.

A typical analysis of a 40% composite produced in accordance with the invention is given as follows:

| | |
|---|---|
| Al | 40% |
| Fe | 58% |
| Mn | 0.5% of max |
| Cu | 0.1% of max |
| C | 0.06% of max |
| P | 0.02% of max |
| S | 0.005% of max |

The density of the matrix alloy itself used in the composite (65% Al alloy) is about 4 gr/cm$^3$; whereas, the apparent density of the composite pig ranges from about 5.6 to 6 gr/cm$^3$. The alloy has a melting point of about 1950° F. (1650° C.); whereas, the aluminum employed in the ingot of U.S. Pat. No. 4,801,328 has a much lower melting point of about 659° C. (1218° F.).

As stated hereinbefore, the matrix alloy in the composite pig of the invention has lower reactivity than pure aluminum which provides a more controlled deoxidation process with minimal loss of the deoxidant. In the case of aluminum per se, the reaction is so rapid that it tends to create a condition where any unused deoxidizer not in the presence of soluble oxygen will react instead with and deoxidize the slag rather than the metal.

In summary, the invention provides a composite pig of a ferro-aluminum alloy of enhanced density which is useful as an alloy addition to steel as well as a deoxidizer for steel. It enables the carrying out of an improved process for adding aluminum to ferrous metals and, in particular, as an improved process for deoxidizing steel.

The invention also provides a method for producing a composite pig of a ferro-aluminum alloy comprising establishing a melt of a matrix-forming ferro-aluminum alloy containing about 55% to 75% and the balance essentially iron, providing a mold having a cavity in the shape of a pig having confined therein pieces of spatially arranged iron or steel, pouring the melt into said mold and allowing said melt to penetrate the spaces between said pieces and form a matrix surrounding said pieces, the amount of iron or steel pieces in the mold being sufficient to provide an overall composition of the composite pig containing about 25% to 55% aluminum, and the balance iron.

The term "pig" employed herein is not to be construed as limiting. It is meant to include any composite casting be it an ingot or sections thereof and sections of pigs, such as pigs having spaced lines of demarkation to enable the pigs to be broken easily for adding to a ferrous melt to be treated.

Although the present invention has been described in conjunction with preferred embodiment, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. As an article of manufacture, a ferro-aluminum addition agent for ferrous metals in the form of a composite pig, said composite pig comprising a matrix of a ferro-aluminum alloy containing by weight of over 55% and ranging up to about 75% aluminum and the balance essentially iron, said matrix alloy having distributed therethrough pieces of iron or steel in an amount sufficient to provide an overall pig composition of about 25% to 55% aluminum and the balance essentially iron, said composite pig being produced by casting said matrix alloy about said pieces of iron or steel.

2. The article of manufacture of claim 1, wherein the matrix alloy of the composite pig has an aluminum concentration of about 60% to 70%.

3. A deoxidizing agent for ferrous metals in the form of a composite pig, said composite pig comprising a matrix of a ferro-aluminum alloy containing by weight of over 55% and ranging up to about 75% aluminum and the balance essentially iron, said matrix alloy having distributed therethrough pieces of iron or steel in an amount sufficient to provide an overall pig composition of about 25% to 55% aluminum and the balance essentially iron, said composite pig being produced by casting said matrix alloy about said pieces of iron or steel.

4. The deoxidizing agent as in claim 3, wherein the matrix alloy of the composite pig has an aluminum concentration of about 60% to 70%.

5. The deoxidizing agent as in claim 4, wherein the amount of the pieces of iron or steel in the composite pig is sufficient to provide an overall composition containing about 35% to 45% aluminum.

6. A method for producing a composite pig of a ferro-aluminum alloy which comprises, establishing a melt of a matrix-forming ferro-aluminum alloy containing about 55% to 75% aluminum and the balance essentially iron, providing a mold having a cavity in the shape of a pig and having confined therein pieces of spatially arranged iron or steel, pouring said melt of ferro-aluminum alloy into said mold and allowing said melt to penetrate spaces between said pieces and form a matrix surrounding said spatially arranged pieces of iron and steel, the amount of iron or steel pieces in the mold being sufficient to provide a composite pig having an overall composition containing about 25% to 55% aluminum and the balance essentially, and solidifying said melt surrounding said pieces of iron or steel and thereby provide a composite pig thereof.

7. The method of claim 6, wherein the matrix alloy contains about 60% to 70% aluminum, and wherein the amount of iron or steel pieces in the mold is such as to provide a composite pig having an overall composition containing about 35% to 45% aluminum.

8. A method of deoxidizing steel which comprises, providing a composite pig comprising a matrix of a ferro-aluminum alloy containing by weight of over 55% and ranging up to about 75% aluminum and the balance essentially iron, said matrix alloy having distributed therethrough pieces of iron or steel in an amount sufficient to provide an overall composition of about 25% to 55% aluminum, and the balance essentially iron, said composite pig having an apparent density of at least about 5 gr/cm$^3$, and submerging an amount of said composite pig into a molten steel bath sufficient to deoxidize said steel bath.

9. The method of claim 8, wherein the amount of pieces of said iron or steel in the composite pig is sufficient to provide an overall composition of about 35% to 45% aluminum in said pig submerging into said steel bath.

* * * * *